US006065325A

United States Patent [19]

Tsai

[11] Patent Number: 6,065,325

[45] Date of Patent: May 23, 2000

[54] AUTOMATIC STAMPING MACHINE

[76] Inventor: Sou-Jun Tsai, No. 204, Ching-Pu Rd., Chingshui Town, Taichung County, Taiwan

[21] Appl. No.: 09/318,216

[22] Filed: May 26, 1999

[51] Int. Cl.[7] ..... B21D 43/20

[52] U.S. Cl. ..... 72/424; 72/419; 72/17.3

[58] Field of Search ..... 72/17.3, 18.1, 72/19.4, 417, 418, 419, 420, 421, 422, 424; 414/224, 225

[56] References Cited

U.S. PATENT DOCUMENTS 4,573,861 3/1986 Aschauer ..... 414/751
5,182,936 2/1993 Sartorio ..... 72/420
5,894,754 4/1999 Sartorio ..... 72/422
5,964,119 10/1999 Kutschker ..... 72/420

*Primary Examiner*—Ed Tolan
*Attorney, Agent, or Firm*—Rosenberg, Klein & Lee

[57] ABSTRACT

An automatic stamping machine, which includes a material feed unit controlled to feed metal sheet materials one after another, a locating unit controlled to position metal sheet materials carried from the material feed unit one after another, a conveyer unit controlled to convey metal sheet materials from the locating unit to a material dispensing unit, a material dispensing unit controlled to dispense metal sheet materials from the conveyer unit to a stamping unit one after another at a predetermined time interval, and a stamping unit controlled to stamp metal sheet materials into shape one after another.

1 Claim, 9 Drawing Sheets

AUTOMATIC STAMPING MACHINE

BACKGROUND OF THE INVENTION

The present invention relates to a stamping machine, and more particularly to an automatic stamping machine which has means to automatically carry metal sheet materials one after another into stamping position for stamping into shape by a stamping unit.

A conventional stamping machine is designed to stamp a metal sheet material into shape, for example, a can lid. During operation, the worker feeds metal sheet materials to the stamping machine one after another for stamping. This stamping operation consumes much labor and working time, thereby causing the manufacturing cost unable to be reduced. Because metal sheet materials are put into stamping position by labor, fed metal sheet materials may be not accurately positioned. If a fed metal sheet material is not accurately positioned, a quality finished product cannot be achieved.

SUMMARY OF THE INVENTION

The present invention provides an automatic stamping machine which eliminates the aforesaid drawbacks. According to the present invention, the automatic stamping machine comprises a material feed unit controlled to feed metal sheet materials one after another, a locating unit controlled to position metal sheet materials carried from the material feed unit one after another, a conveyer unit controlled to convey metal sheet materials from the locating unit to a material dispensing unit, a material dispensing unit controlled to dispense metal sheet materials from the conveyer unit to a stamping unit one after another at a predetermined time interval, and a stamping unit controlled to stamp metal sheet materials into shape one after another. Because fed metal sheet materials are automatically and accurately carried one after another into stamping position for stamping into shape, less labor is needed, and the quality of finished products is constantly maintained.

DETAILED DESCRIPTION OF THE PREFERRED EMBODIMENT

Figure 1:
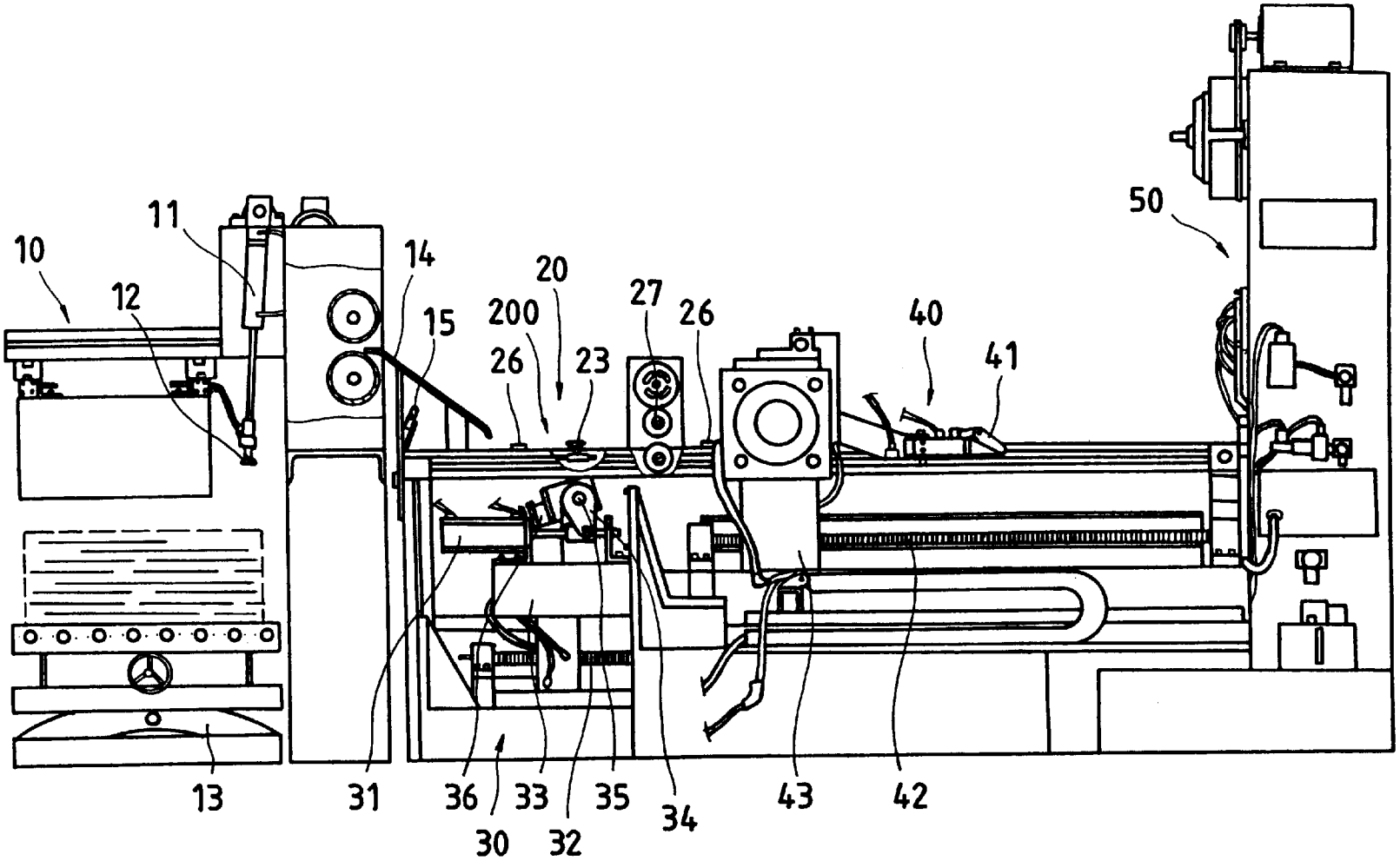
FIG. 1 is a side view of an automatic stamping machine according to the present invention.
Figure 2:
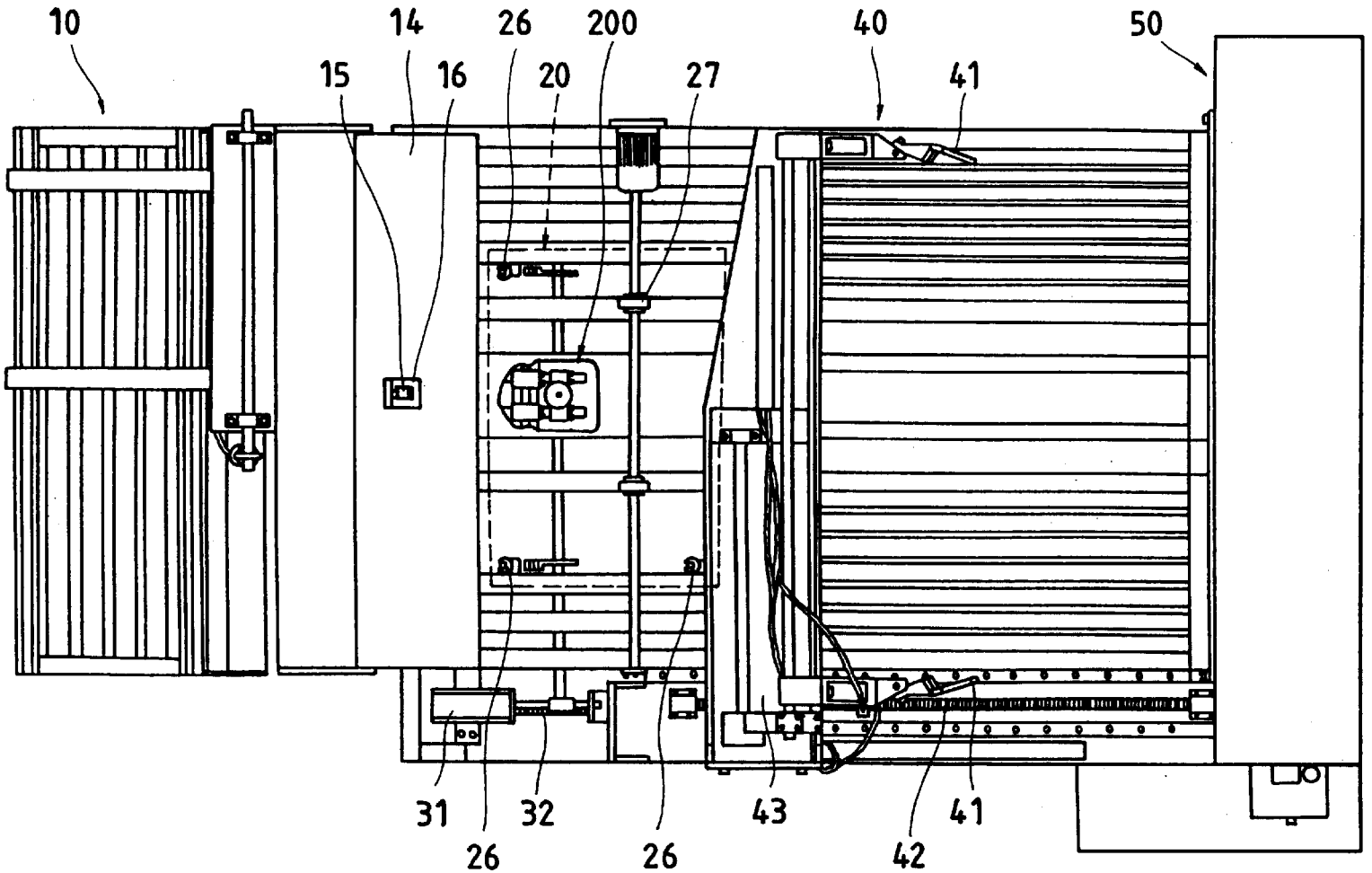
FIG. 2 is a top view of the automatic stamping machine shown in FIG. 1.

Referring to FIGS. 1 and 2, an automatic stamping machine in accordance with the present invention is generally comprised of a material feed unit 10, a locating unit 20, a conveyer unit 30, a material dispensing unit 40, and a stamping unit 50.

Referring to FIGS. 1 and 2 again, the material feed unit 10 comprises a lift 13 controlled to lift metal sheet materials step by step, an air cylinder 11, and a suction disk 12 connected to the air cylinder 11 and operated to carry metal sheet materials one after another from the lift 13 to the locating unit 20.

Figure 3:
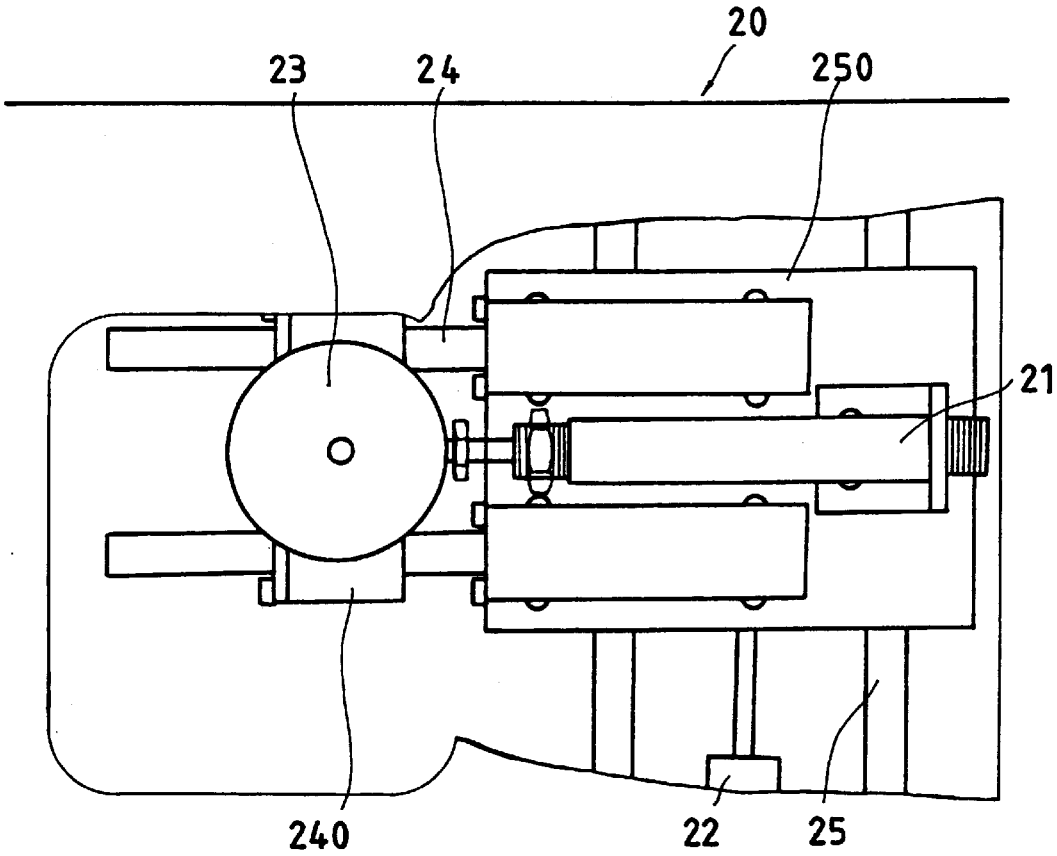
FIG. 3 is a top view of a part of the present invention, showing the arrangement of the material transferring mechanism.
Figure 4:
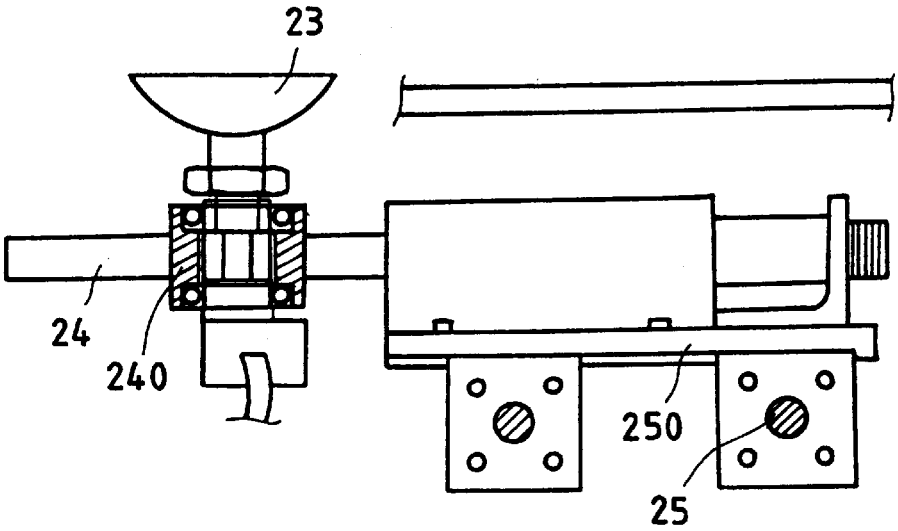
FIG. 4 is a side view of FIG. 3.

Referring to FIGS. 3 and 4, the locating unit 20 comprises three locating blocks 26 at the grilled top thereof, a material transferring mechanism 200 on the middle, an oblique guide board 14 disposed between the material transferring mechanism 200 and the material feed unit 10, the oblique guide board 14 having a center hole 16, and a sensor 15 aimed at the center hole 16 and controlled to detect the presence of a metal sheet material at the oblique guide board 14. The material transferring mechanism 200 comprises a pair of longitudinal guide rods 24, a slide 240 moved along the longitudinal guide rods 24, a pair of transverse guide rods 25, a carriage 250 moved along the transverse guide rods 25, a suction disk 23 mounted on the slide 240 for carrying a metal sheet material, a longitudinal air cylinder 21 controlled to reciprocate the slide 240 on the longitudinal guide rods 24, and a transverse air cylinder 22 controlled to reciprocate the carriage 250 on the transverse guide rods 25. The longitudinal guide rods 24 are mounted on the carriage 250, so that the slide 240 can be moved with the carriage 250.

Figure 5:
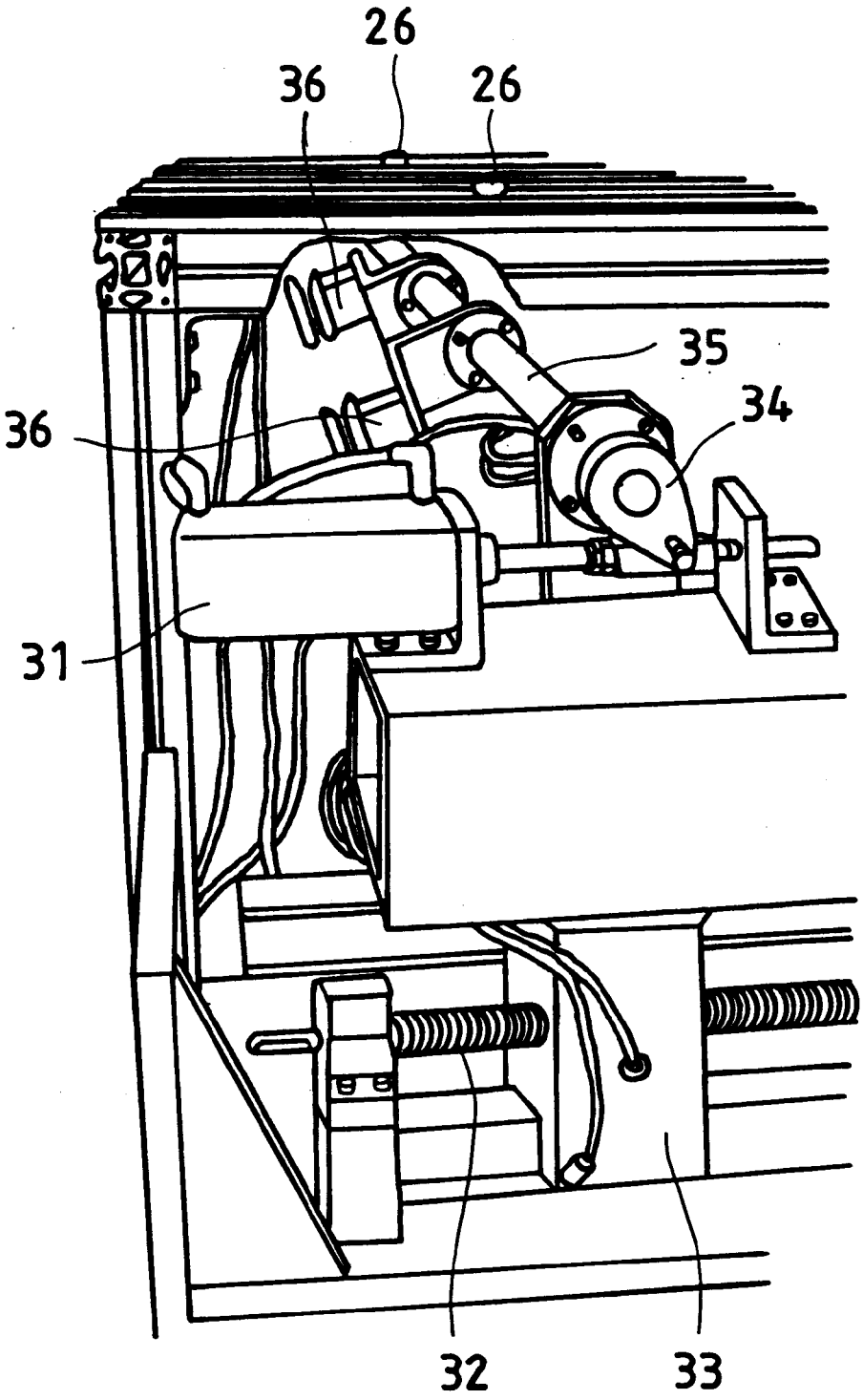
FIG. 5 is a perspective view of a part of the present invention, showing the arrangement of the conveyer unit.

Referring to FIG. 5 and FIGS. 1 and 2 again, the conveyer unit 30 comprises a screw rod 32, a base 33 mounted on the screw rod 32 and driven to move along the screw rod 32, an air cylinder 31 mounted on the base 33, a crank arm formed of a rocker 34 and a rotary rod 35 and turned back and forth by the air cylinder 31, and fixture means 36 mounted on the rotary rod 35 and turned with the rotary rod 35 out of the grilled top of the locating unit 20 to hold a metal sheet material.

Figure 10:
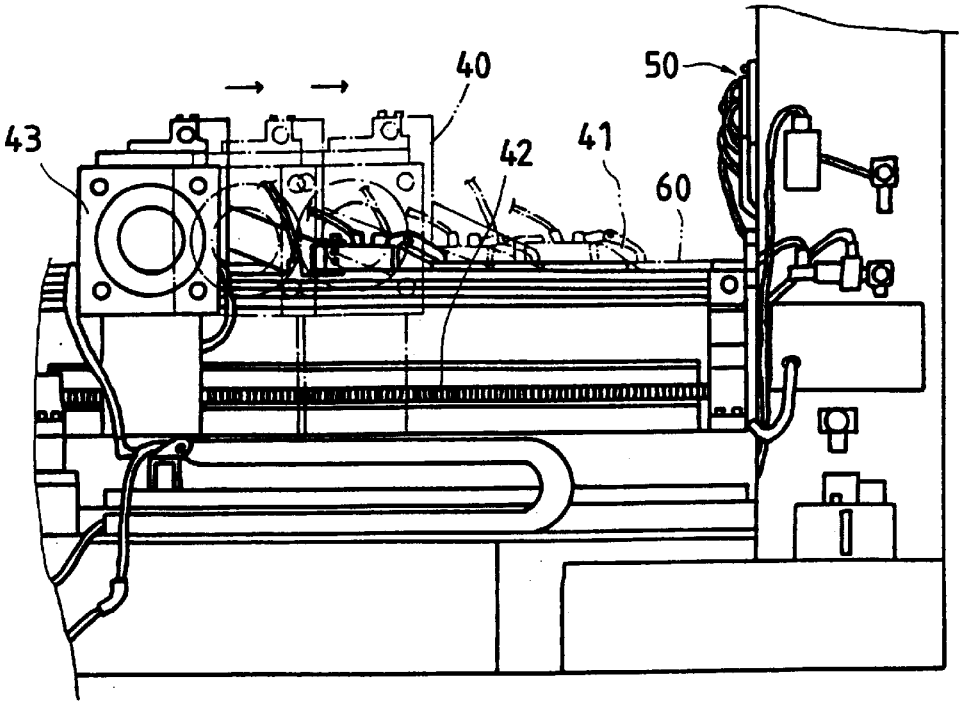
FIG. 10 is a side view of a part of the present invention, showing the arrangement of the material dispensing unit.
Figure 11:
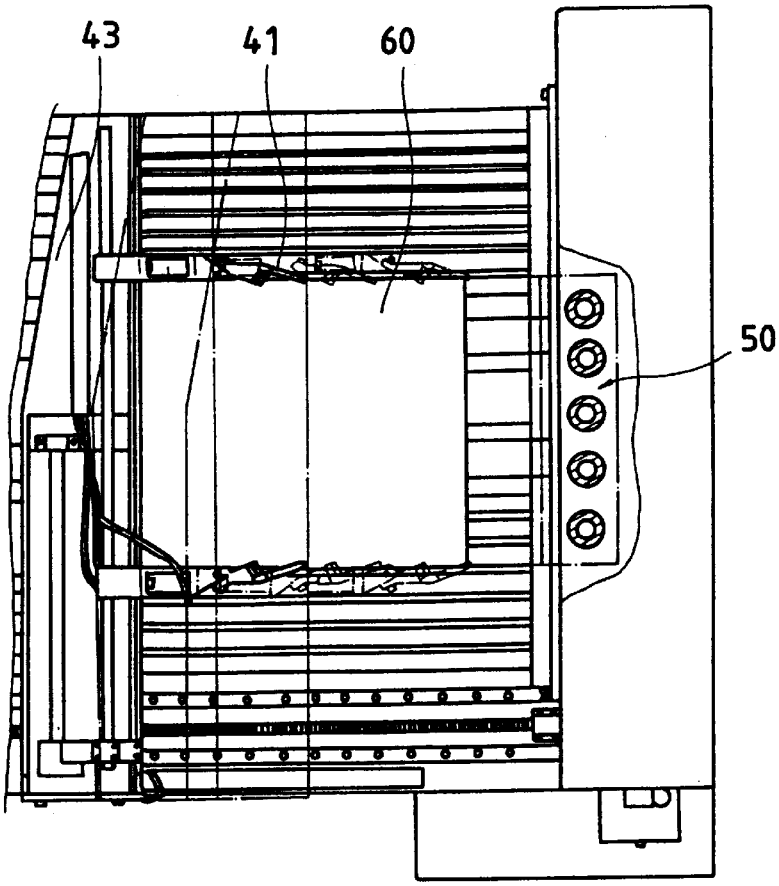
FIG. 11 is a top view of FIG. 10.

Referring to FIGS. 10 and 11, the material dispensing unit 40 comprises a screw rod 42, a sliding block 43 driven to move along the screw rod 42 between the conveyer unit 30 and the stamping unit 50, and a plurality of mechanical arms 41 symmetrically provided at two opposite sides of the sliding blocks 43 and controlled to carry metal sheet materials one after another at a predetermined time interval from the conveyer unit 30 to the stamping unit 50 for stamping.

The operation of the automatic stamping machine is outlined hereinafter.

Figure 6:
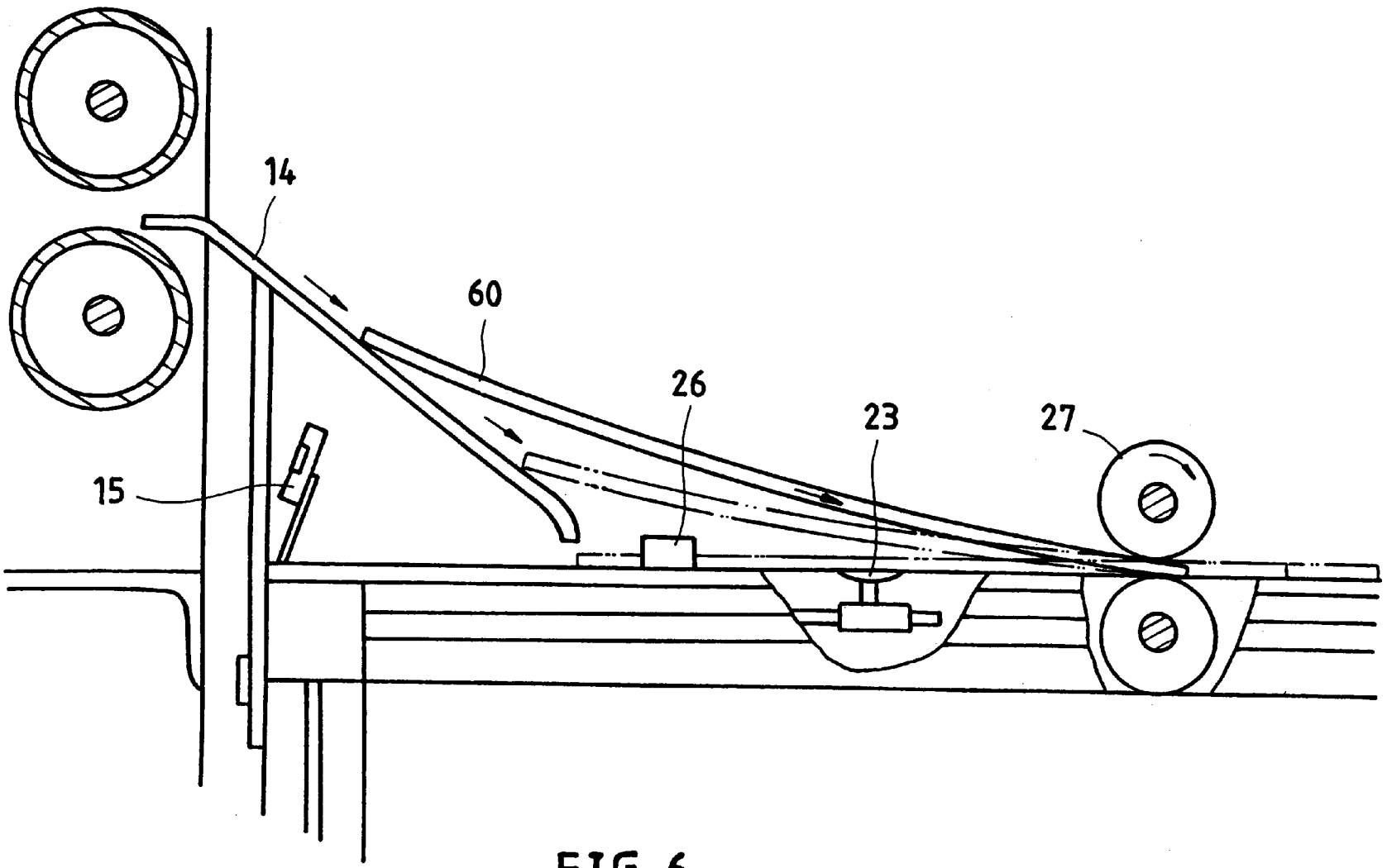
FIG. 6 is a partial view of the present invention, showing one metal sheet material moved over the oblique guide board to the material transferring wheel.
Figure 7:
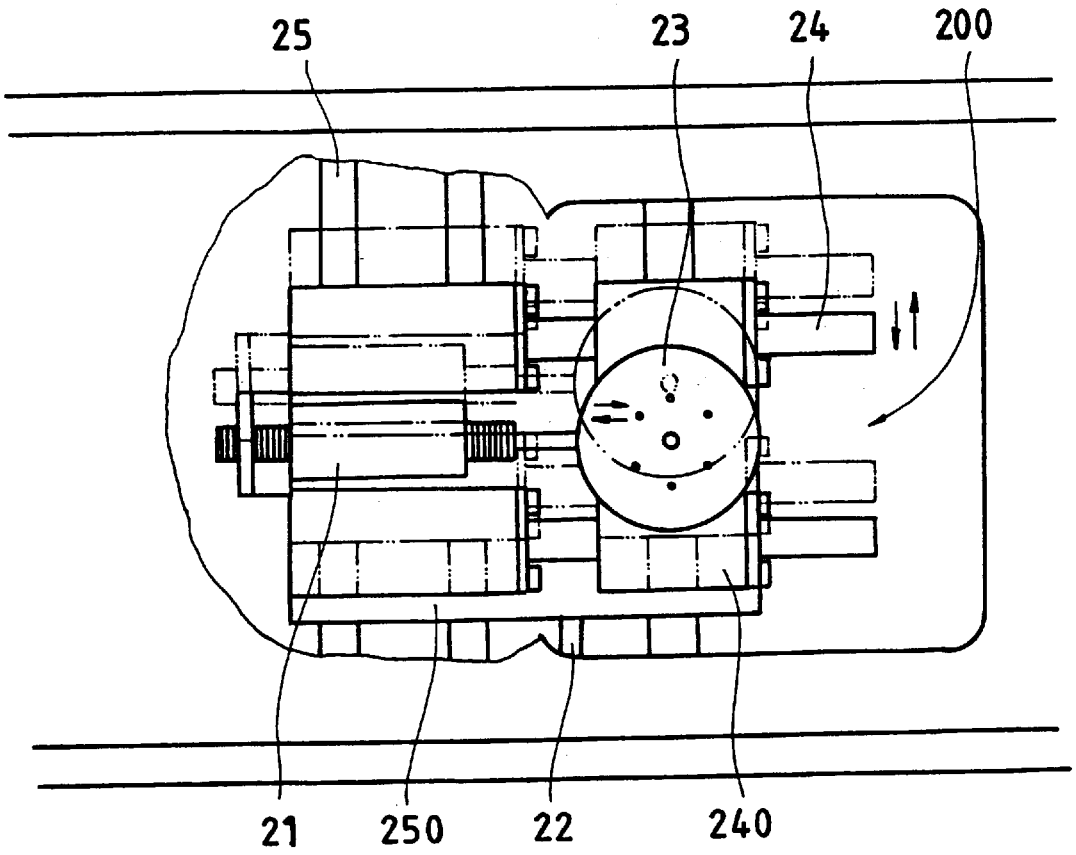
FIG. 7 is a partial view of the present invention, showing the locating unit operated.
Figure 8:
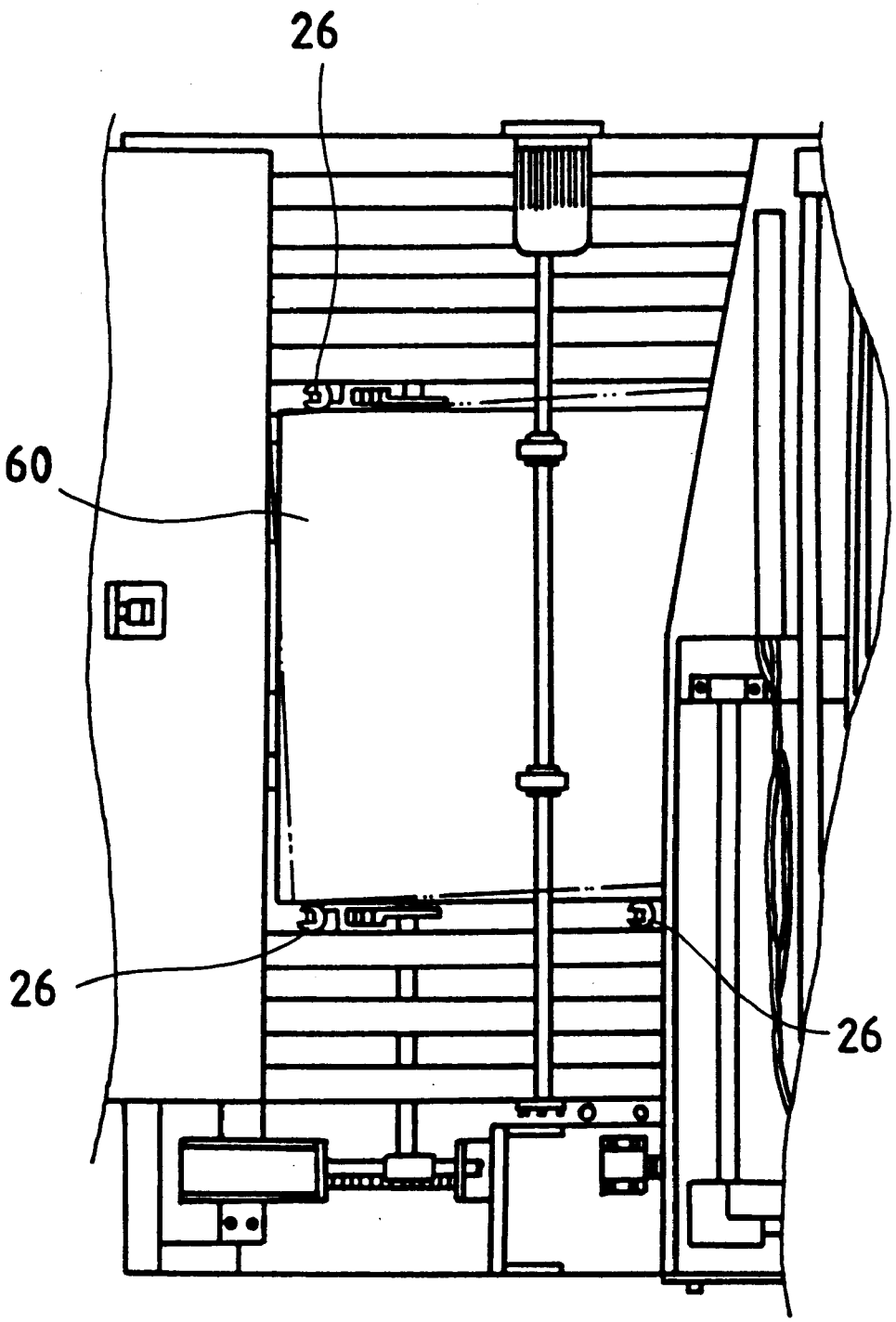
FIG. 8 is a top view of a part of the present invention, showing one metal sheet material stopped at the locating blocks.
Figure 9:
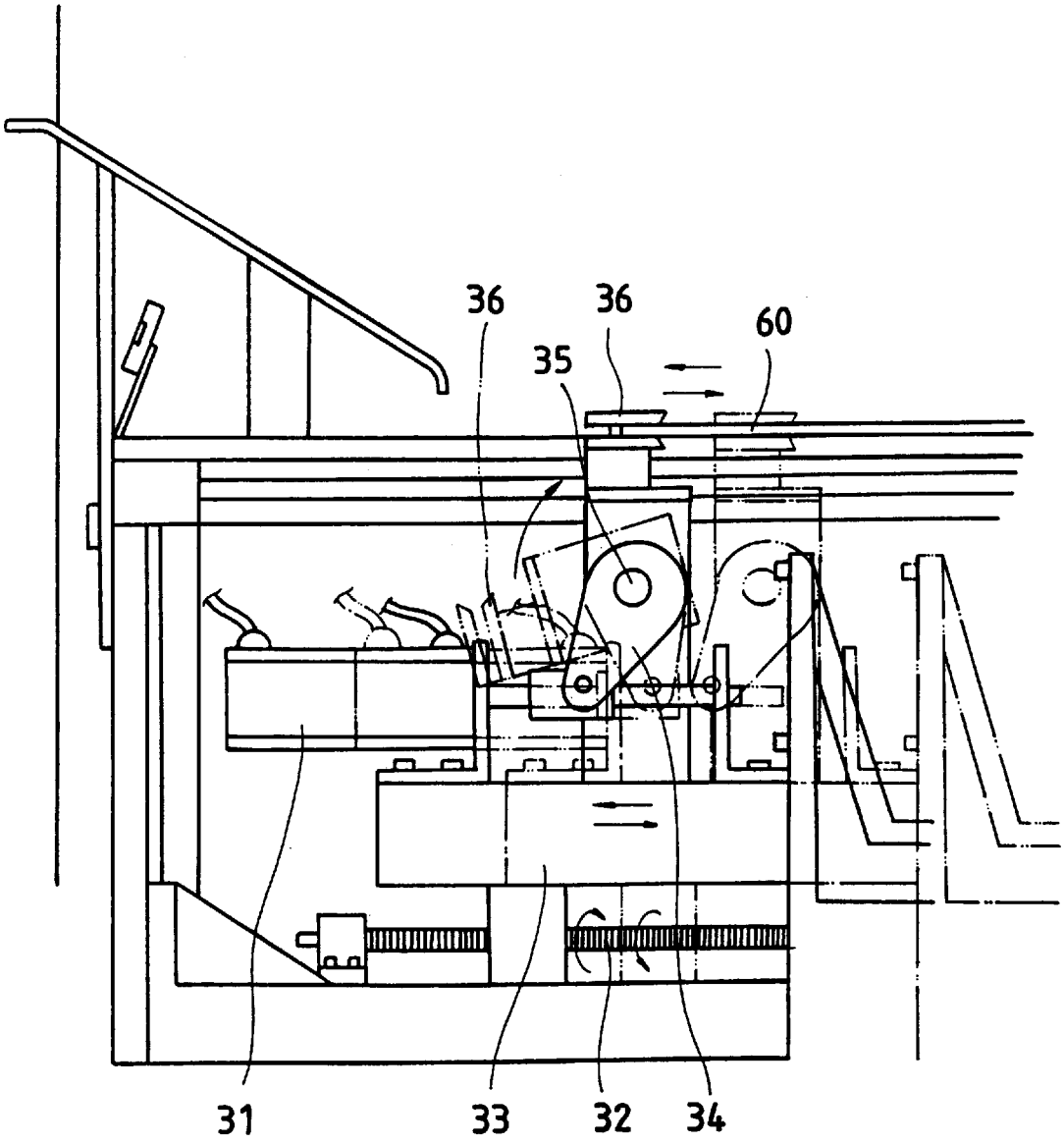
FIG. 9 is a side view of a part of the present invention, showing the conveyer unit operated.

Metal sheet materials 60 are carried one after another by the suction disk 12 of the material feed unit 10 to the oblique guide board 14 (see FIG. 6). When a metal sheet material 60 is carried to the oblique guide board 14, it is transferred forwards at a short distance to a horizontal position by a material transferring wheel 27. When moved to a horizontal position, the metal sheet material 60 is sucked by the suction disk 23 of the material transferring mechanism 200, and the slide 240 and carriage 250 of the material transferring mechanism 200 are controlled to move the suction disk 23, enabling the metal sheet material 60 to be stopped at the locating blocks 26 (see FIGS. 7 and 8). After setting into position, the air cylinder 31 of the conveyer unit 30 is operated to turn the rocker 34 and the rotary rod 35 through a predetermined angle, enabling the metal sheet material 60 to be seized by the fixture means 36 (see FIG. 9). When captured by the fixture means 36, the suction force of the suction disk 23 is released, then the screw rod 32 of the conveyer unit 30 is rotated, causing the metal sheet material 60 to be moved with the base 33 along the screw rod 32 to the material dispensing unit 40, and then seized by the mechanical arms 41 of the material dispensing unit 40 (see FIG. 10). Thereafter, the screw rod 32 is rotated in the reversed to return the conveyer unit 30 for a next metal sheet material conveying operation, and the air cylinder 31 is received back, causing the fixture means 36 and the metal sheet material 60 to be lowered to the elevation below the grilled top of the locating unit 20.

After the metal sheet material 60 has been seized by the mechanical arms 41 of the material dispensing unit 40, the screw rod 42 is rotated at a set length of time, enabling the metal sheet material 60 to be carried to the stamping unit 50, and then stamped into shape, and then the material dispensing unit 40 is returned to its former position for a next dispensing operation (see FIGS. 10 and 11).

While only one embodiment of the present invention has been shown and described, it will be understood that various modifications and changes could be made thereunto without departing from the spirit and scope of the invention disclosed.

What the invention claimed is:

1. An automatic stamping machine comprising a material feed unit controlled to feed metal sheet materials one after another, a locating unit controlled to position metal sheet materials carried from said material feed unit one after another, a conveyer unit controlled to convey metal sheet materials from said locating unit to a material dispensing unit, a material dispensing unit controlled to dispense metal sheet materials from said conveyer unit to a stamping unit one after another at a predetermined time interval, and a stamping unit controlled to stamp metal sheet materials into shape one after another, wherein:

said locating unit comprises three locating blocks at a grilled top thereof for stopping a fed metal sheet material in position, a material transferring mechanism on the middle controlled to transfer metal sheet materials one after another to said conveyer unit, an oblique guide board disposed between said material transferring mechanism and said material feed unit for guiding fed metal sheet materials forwards, said oblique guide board having a center hole, and a sensor aimed at the center hole at said oblique guide board and controlled to detect the presence of a metal sheet material at said oblique guide board, said material transferring mechanism comprising a pair of longitudinal guide rods, a slide moved along said longitudinal guide rods, a pair of transverse guide rods, a carriage moved along said transverse guide rods, a suction disk mounted on said slide for carrying a metal sheet material forwards, a longitudinal air cylinder controlled to reciprocate said slide on said longitudinal guide rods, and a transverse air cylinder controlled to reciprocate said carriage on said transverse guide rods, said longitudinal guide rods being mounted on said carriage;

said conveyer unit comprises a screw rod, a base driven to move along the screw rod of said conveyer unit, an air cylinder mounted on said base, a crank arm formed of a rocker and a rotary rod and turned back and forth by the air cylinder of said conveyer unit, and fixture means mounted on said rotary rod and turned with said rotary rod out of the grilled top of said locating unit to hold a metal sheet material;

said material dispensing unit comprises a screw rod, a sliding block driven to move along the screw rod of said material dispensing unit between said conveyer unit and said stamping unit, and a plurality of mechanical arms symmetrically provided at two opposite sides of said sliding blocks and controlled to carry metal sheet materials one after another at a predetermined time interval from said conveyer unit to said stamping unit for stamping.

* * * * *